United States Patent [19]

Sahara

[11] 4,099,573

[45] Jul. 11, 1978

[54] SPRINKLER HEAD

[75] Inventor: Tamotsu Sahara, Tokyo, Japan

[73] Assignee: Hitachi Plant Engineering and Construction Co., Ltd., Tokyo, Japan

[21] Appl. No.: 752,542

[22] Filed: Dec. 20, 1976

[30] Foreign Application Priority Data

May 13, 1976 [JP] Japan ..... 51-54973

[51] Int. Cl.[2] ..... A62C 37/08

[52] U.S. Cl. ..... 169/37; 169/23

[58] Field of Search ..... 169/37–41, 169/23, 75; 116/114 S, 117 R; 137/557, 559

[56] References Cited

U.S. PATENT DOCUMENTS

| | | | |
|---|---|---|---|
| 886,128 | 4/1908 | Howard | 169/23 |
| 2,708,482 | 5/1955 | Nurkiewicz | 169/75 X |

FOREIGN PATENT DOCUMENTS

| | | | |
|---|---|---|---|
| 599,160 | 6/1934 | Fed. Rep. of Germany | 169/37 |

*Primary Examiner*—John J. Love

*Attorney, Agent, or Firm*—Koda and Androlia

[57] ABSTRACT

An improved sprinkler head for use in fire retarding systems including means for confirming the presence of water pressure at the sprinkler head. The confirming means includes a valve means provided in the sprinkler head and coupled to the water input of the sprinkler head and a pressure detection port provided in the sprinkler head coupled to the water input of the sprinkler head via the valve means whereby a pressure gauge may be connected to the port and the valve means opened so that the water pressure may be determined.

11 Claims, 3 Drawing Figures

SPRINKLER HEAD

BACKGROUND OF THE INVENTION

1. Field of Invention

This invention relates to sprinkler heads for fire extinguishing systems and more particularly to means for determining the presence of water pressure in the sprinkler head of such systems.

2. Prior Art

Sprinkler systems containing a large number of sprinkler heads equipped with heat sensing components for the purpose of extinguishing flames by means of sprinkling water when a fire occurs have recently been widely used for the purpose of countering fires in buildings, etc. In conventional sprinkler systems, however, it is necessary to actually activate the heat sensing component of the sprinkler head (so that the head sprinklers) in order to confirm that water is being supplied to the installed sprinkler head. A sprinkler head once activated in this way must be replaced by an unused head. Accordingly, a great deal of time and expense is required.

SUMMARY OF THE INVENTION

Accordingly, it is a general object of the present invention to provide a nondestructive means for determining the presence of water pressure at a sprinkler head.

It is yet another object of the present invention to provide a means for confirming the presence of water pressure at a sprinkler head which is easy to use, reliable and fast.

It is still another object of the present invention to provide a means for confirming the presence of water pressure at a sprinkler head which may also be used to purge air from the sprinkler system.

In keeping with the principles of the present invention, the objects are accomplished by a unique improved sprinkler head for use in fire extinguishing systems. The improved sprinkler head includes means for confirming the presence of water pressure at the sprinkler head. The confirming means includes a valve means provided in a sprinkler head and coupled to the water input of the sprinkler head and a pressure detection port provided in the sprinkler head which is coupled to the water input of the sprinkler head via the valve means whereby a pressure gauge may be connected to the pressure detection port and the valve means opened so that the water pressure may be determined.

BRIEF DESCRIPTION OF THE DRAWINGS

The above mentioned and other features and objects of the present invention will become more apparent by reference to the following description taken in conjunction with the accompanying drawings, wherein like reference numerals denote like elements and in which.

DESCRIPTION OF THE PREFERRED EMBODIMENT

Figure 1:
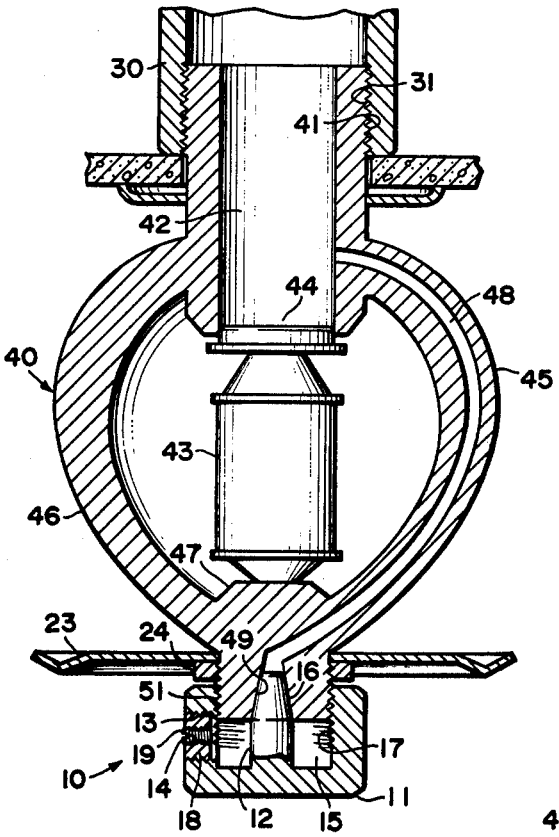
FIG. 1 is a cross-sectional view of an improved sprinkler head in accordance with the teachings of the present invention.

Referring more particularly to the drawings, FIG. 1 is an improved sprinkler head in accordance with the teachings of the present invention. In FIG. 1, the sprinkler head 40 is coupled to a water delivery pipe 30. The water delivery pipe 30 is suspended from the structure of a building and one end of the delivery pipe 30 is coupled to a source of water, not shown. One end of delivery pipe 30 is provided with female threads 31. Sprinkler head 40 is coaxial with water delivery pipe 30 and male threads 41 provided on the exterior of head pipe 42 located at the top of sprinkler head 40 mate with the female threads 31 of the water delivery pipe 30 such that water from the water delivery pipe 30 is provided to the sprinkler head 40 through the head pipe 42.

The sprinkler head 40 further contains a thermostat 43 equipped with a heat sensing component which is designed so that water from the delivery pipe 30 is caused to sprinkle from the opening 44 in the lower end of head pipe 42 by the activation of the thermostat 43 due to thermostat 43 sensing the temperature of the surrounding air during a fire.

Furthermore, the sprinkler head 40 has two fork arms 45 and 46 coupled to head pipe 42 just below the threads 41. The arms 45 and 46 are designed so that their lower ends are connected to thermostat support 47 in order to support the bottom of thermostat 43. A branch passage 48 is provided in one of the arms 45. The upper end of this passage 48 is coupled to the head pipe 42 and the lower end is coupled and the upper end of a tapered hole 49 which is drilled in the thermostat support 47 such that its diameter increases in a downward direction. Futhermore, male threads 51 are provided on the exterior surface of the thermostat support 47. A means for confirming water pressure in sprinkler heads 10 is provided on the thermostat support 47. The means for confirming water pressure in sprinkler heads 10 consists of a restraining part 11, a pressure detection port 13 and a purge vent 14. The restraining part 11 is in the form of a cap nut and includes a hollow space 15 provided in the inside of the nut and a valve 12 formed by a tapered plug 16 whose slope is identical to that of the tapered hole 49 at the end of branch opening 48. The tapered hole 49 is provided in the center of the space 15. By tightening the restraining part 11 the female threads 17 provided on the interior of the hollow space 15 thread onto the male threads 51 of thermostat support 47 thereby causing tapered portion 16 of valve 12 to fit into tapered hole 49 so that the branch passage 48 is closed. Loosening the restraining part 11 causes the tapered plug 16 to be removed from the tapered hole 49 so that the hollow space 15 is coupled to the branch passage 48, see FIGS. 2 and 3.

Furthermore, a pressure detection port 13, which is equipped with female threads, is provided in a portion of the restraining part 11. A bolt portion 18 is screwed into the pressure detection port 13. A purge vent 14, which is equipped with female threads, is provided through the center of bolt 18 so that the vent is coaxial with the pressure detection port 13. A bolt 19 is screwed into the purge vent 14.

Figure 2:
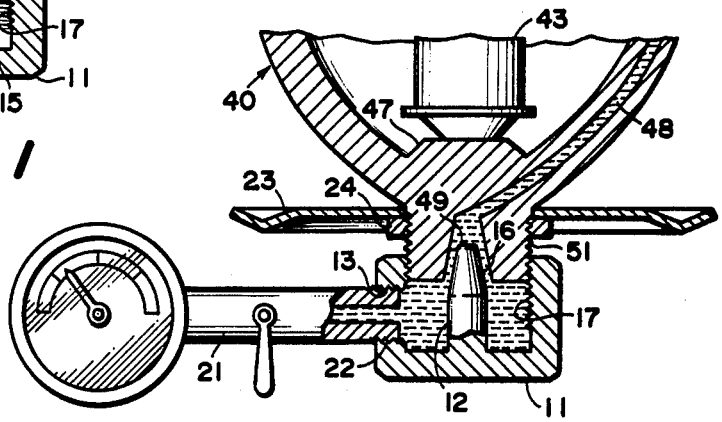
FIG. 2 is a cross-sectional view of an improved sprinkler head in accordance with the teachings of the present invention illustrating the attachment of a pressure gauge during confirmation.

Thus, when the bolt 19 is removed from the bolt 18, the hollow space 15 of the restraining part 11 is connected to the atmosphere via the purge vent 14. Similarly, when the bolt 18 is removed from the pressure detection port 13, the hollow space 15 is coupled with the atmosphere via the pressure port 13. In addition, when the bolt 18 has been removed from the pressure detection port 13, it is possible to screw a male threaded portion of a pressure gauge 21 into the pressure detection port 13, as shown in FIG. 2. Disc 23 is fastened to a thermostat 47 by a nut 24. The disc 23 receives the water sprayed from the opening 44 during a fire and causes it to be sprinkled about appropriately.

In operation, as shown in FIG. 1, water is delivered to the sprinkling system installed in a building by a source of water, not shown. The water is delivered under pressure to the water delivery pipe 30 and to the head pipe 42 and branch passageway 48 of the sprinkler head 40. Normally, however, the heat sensing component 43 of the sprinkler head 40 is unactivated so that no water is sprinkled from the opening of the sprinkler head 40 and branch passageway 48 is closed by the engagement of the tapered parts 16 and 49 so that no water flows out of the branch passageway 48. Next, as shown in FIG. 2, the bolt 18 is removed for attachment of a pressure gauge 21 and the male threaded portion of pressure gauge 21 is screwed into the female threads 13 of the restraining part 11 in order to confirm water pressure. Then, to confirm the water pressure, the restraining part 11 is rotated so that the tapered portion 49 of the branch passageway 48 and the tapered portion 16 of the valve 12 are separated from each other, as shown in FIG. 2. Thus, the branch passageway 48 is open so that water flows through the space between the tapered parts 16 and 19 and presses against the measuring part of the pressure gauge 21 attached to the restraining part 11 thereby enabling the water pressure to be reliably measured. If the water is not being delivered to sprinkler head 40, this water pressureless condition can be easily confirmed by checking the dial on the pressure gauge 21. After the measurement of the water pressure has been made, the sprinkler head 40 is returned to its initial state by a reverse of the steps described above.

Figure 3:
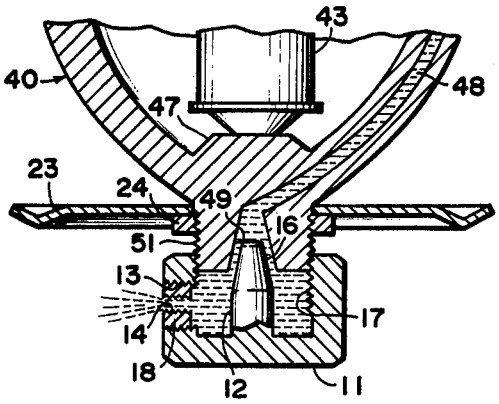
FIG. 3 is a cross-sectional view which illustrates the purging of air from the water delivery pipe and sprinkler head.

Furthermore, when it is necessary to purge air from the water delivery pipe 30 and from all parts of the sprinkler head 40 for delivery of water to the sprinkler head 40, the purging can be easily accomplished (as shown in FIG. 3) by unscrewing the bolt 19 from the bolt 18 so that the hollow space 15 of the restraining part 11 is coupled to the atmosphere. Then the restraining part 11 is unscrewed such that tapered portions 16 and 49 disengage thereby allowing air to be purged from the aforementioned parts through the purging vent 14 until the sprinkler head is completely filled with water.

It should be apparent that the purge vent 14 does not necessarily have to be provided in the bolt 18 and it could be provided in another portion of the restraining part 11. Furthermore, the valve 12 described as closing the branch passageway 48 by means of a tapered portion 16 can be any valve means which can reliably open and close the branch opening 48 and can be installed anywhere so long as it can open and close a branch passageway coupled to the head pipe 42. Also, the restraining part 11 is not limited to screws, cams, springs, etc. Any restraining part which can hold the valve in the branch passageway in such a manner that it can be opened when desired is also within the scope of such invention. In addition, the valves and restraining part do not have to be built as a unit. Any arrangement in which the valve is caused to open and close the branch passageway by operation of a restraining part is within the scope of the present invention.

As described above, the device for confirming water pressure in sprinkler heads in accordance with the teachings of the present invention possesses the following merits: (a) it can be used without any need for special tools, (b) it conserves the water pressure in the sprinkler head so that an accurate confirmation is possible, (c) it increases the efficiency of inspection work, (d) it offers improved reliability and (e) it allows for a simplified air purging of the sprinkler system.

In all cases it is understood that the above described embodiment is merely illustrative of but one of the many possible specific embodiments which can represent the applications of the principles of the present invention. Numerous and varied other arrangements can be readily devised by those skilled in the art without departing from the spirit and scope of the invention.

I claim:

1. A device for confirming water pressure in sprinkler heads of the type including two forking arms connected to a head pipe near the area of junction with a water delivery pipe at one end and coupled at the other end to a part that supports a heat-sensing component, comprising:

a branch passageway connected with said head pipe of said sprinkler head which sprinkles water during a fire due to the activation of said heat-sensing component, said branch passageway being drilled through at least one of the two forking arms such that it communicates with said part that supports said heat-sensing component;

a valve means which opens and closes the branch passageway by contact with, and separation from, said passageway;

a restraining part which holds said valve in said passageway such that said valve is removed from the branch passageway when said restraint is loosened; and a pressure detection port provided in said restraining part and connected with said branch passageway when the branch passageway is opened by said valve, and to which pressure gauge may be connected.

2. A device for confirming water pressure in sprinkler heads according to claim 1 wherein that portion of said branch passageway which comes into contact with said valve is tapered, and said valve is tapered such that said valve fits said taper of said branch passageway.

3. A device for confirming water pressure in sprinkler heads according to claim 1 wherein said restraining part is screw-connected to said sprinkler head, and said valve is pushed into the branch passageway by the tightening of said restraining part.

4. A device for confirming water pressure in sprinkler heads according to claim 1 further comprising a bolt screwed into the pressure detection port whereby said pressure detection port can be opened by removing said bolt whenever necessary.

5. A device for confirming water pressure in sprinkler heads according to claim 4 further comprising a purge vent drilled through the axis of said bolt.

6. A device for confirming water pressure in sprinkler heads according to claim 5 further comprising a bolt screwed into said purge vent whereby said branch passageway is connected with the atmosphere via said purge vent by removing said bolt from said purge vent when said valve has been removed from said branch passageway.

7. A device for confirming water pressure in sprinkler heads according to claim 1 wherein that portion of said branch passageway which comes into contact with said valve is tapered, said valve is tapered so that it fits said taper, and said restraining part is screw-connected to the sprinkler head whereby said valve is pushed into the branch passageway by the tightening of this screw connection.

8. A device for confirming water pressure in sprinkler heads according to claim 7 wherein said restraining part is in the form of a cap nut containing a hollow space which has female threads provided on an inside rim, said valve is installed upright in the center of said hollow space, and said pressure detection port is provided through a portion of the cap nut.

9. A device for confirming water pressure in sprinkler heads according to claim 8 further comprising a bolt screwed into the pressure detection port whereby said pressure detection port can be opened by removing said bolt whenever necessary.

10. A device for confirming water pressure in sprinkler heads according to claim 9 further comprising a purge vent drilled through the axis of said bolt.

11. A device for confirming water pressure in sprinkler heads according to claim 10 further comprising a bolt screwed into said purge vent whereby said branch passageway is connected with the atmosphere via the purge vent by removing said bolt from the purge vent when said valve has been removed from said branch passageway.

* * * * *